US005664685A

United States Patent [19]

Freissle

[11] Patent Number: 5,664,685

[45] Date of Patent: Sep. 9, 1997

[54] SCREENING ARRANGEMENT

[75] Inventor: Peter Helmut Franz Freissle, Johannesburg, South Africa

[73] Assignee: Manfred Franz Axel Freissle, Johannesburg, South Africa

[21] Appl. No.: 458,576

[22] Filed: Jun. 1, 1995

[51] Int. Cl.[6] ..... B07B 1/49

[52] U.S. Cl. ..... 209/399; 209/405; 209/408

[58] Field of Search ..... 209/397, 399, 209/405, 408, 409, 411, 412, 931

[56] References Cited

U.S. PATENT DOCUMENTS

| | | | |
|---|---|---|---|
| 4,383,919 | 5/1983 | Schmidt | 209/405 X |
| 5,361,911 | 11/1994 | Waites, Sr. et al. | 209/405 X |
| 5,385,242 | 1/1995 | Freissle | 209/399 |
| 5,464,101 | 11/1995 | Freissle | 209/405 |

FOREIGN PATENT DOCUMENTS

| | | | |
|---|---|---|---|
| 236530 | 9/1987 | European Pat. Off. | 209/405 |
| 1505601 | 9/1989 | U.S.S.R. | 209/405 |

*Primary Examiner*—William E. Terrell
*Assistant Examiner*—Tuan Nguyen
*Attorney, Agent, or Firm*—James Ray & Associates

[57] ABSTRACT

A screen support frame component is provided. The screen support frame component supports modular screening panels which are of a hard wearing synthetic plastics material such as polyurethane and are removably secured to the screen support frame component. Each of the screen support frame components includes a base which is elongate plate having a planar surface. A plurality of lugs are longitudinally spaced along the length of the base and project laterally on both sides of the base so that the planar surface of the base extends onto the laterally projecting lugs. A plurality of tubular spacer elements are provided on the base and on the lugs to project upwardly from the planar surface. Each tubular spacer element has a tubular side wall and one open axial end. It further has an annular shoulder inwardly of the open end, and a sloping face flaring outwardly towards the open end. The annular shoulder constitutes a securing formation for securing the screening panels to the screen support frame. The screen support frame components in accordance with the invention permits screening panels to be fitted in a screen without any of the screening apertures being blocked by underlying screen frame supports, this being achieved by mounting the screening panels to be spaced from the surface of the underlying screened frame supports. Screen support frame components according to the invention also permit conversion of existing screen supports by securing a plurality of the screen support frame components to an existing screen support frame.

8 Claims, 3 Drawing Sheets

SCREENING ARRANGEMENT

BACKGROUND OF THE INVENTION

This invention relates to a screening arrangement. More particularly the invention relates to a screen support frame for supporting removable screening panels thereon in a side-by-side abutting relationship. The invention further relates to a method of converting one screening arrangement to another screening arrangement.

A screen support frame is known to the applicant in which screening panels are removably secured to the support frame so that the undersides of the screening panels abut the top surface of the support frame. In the known support frame and screening panels the width of the support frame and the arrangement of screening apertures in the screening panels are such that when the screening panels are secured in position on the support frame, none of the screening apertures are blocked by the support frame. In this known support frame and screening panels the screening area of the screening panels is therefore not impaired by the underlying support frame.

It is sometimes necessary to secure removable screening panels upon a support frame in which the width of the support frame is such that some screening apertures, more specifically some apertures along a margin of a screening panel, are blocked by the underlying support frame. If the screening panels are thus to be used on such a support frame, the screening area of the screening panels would be impaired, and this would be disadvantageous.

It is an object of the invention to overcome the disadvantage of reduced screening area when certain known replaceable screening panels are to be secured onto certain known support frames.

SUMMARY OF THE INVENTION

According to the invention there is provided a screen support frame component which includes a base having a planar surface, and a plurality of spacer elements on the base and projecting from the planar surface, each spacer element having a securing formation which is removably inter-engageable with a complementary securing formation on a screening panel, the spacing between the securing formations on the spacer elements being complementary to the spacing between complementary securing formations on a screening panel such that when a screening panel is secured to the screen support frame component by inter-engagement of the securing formations on the spacer elements with complementary securing formations on a screening panel the underside of the screening panel is spaced from the planar surface of the base.

The base of the screen support frame component may be elongate and may be a plate or a channel.

When the base of the screen support frame component is elongate it may have a plurality of lugs spaced along the length of the base and projecting laterally on one or both sides of the base and forming an extension of the planar surface of the base. The spacer elements may be provided on the elongate section of the base as well as on the laterally projecting lugs.

Each spacer element may be of a tubular configuration and may have one open axial end. An annular ridge may be provided inwardly of the open end to form the securing formation on the spacer element.

The screen support frame component may be of a unitary construction in which the base and the spacer elements are of steel and the spacer elements are secured to the base, for example by means of welding. The screen support frame component may be securable to a support frame directly or by means of an intermediate support frame component. The intermediate support frame component may be a channel of U-shape.

Further according to the invention there is provided a method of converting a screen support frame having a surface, which includes the steps of providing a plurality of spacer elements on the support frame to project from the surface of the support frame, each spacer element having a securing formation which is removably inter-engageable with a complementary securing formation on a screening panel, and the spacing between the spacer elements being complementary to the spacing between complementary securing formations on a screening panel so that when a screening panel is secured to the support frame by inter-engagement of the securing formations on the screening panel with the securing formations on the spacer element, the underside of the screening panel is spaced from the surface of the support frame.

The method of conversion may include the further steps of providing the surface of the screen support frame on a base and providing the spacer elements on the base to project from the surface, and affixing the base to the screen support frame.

The method of conversion may include the still further step of removing a component of the screen support frame and providing the surface of the screen support frame on a base which is complementary in shape to the component the screen support frame which has been removed, providing the spacer elements on the base and affixing the base to the screen support frame.

In a screening arrangement which is to be converted the intermediate support frame component may form part of the existing screening arrangement, and the screen support frame component may be secured thereto when the base of the screen support frame component is a plate. Alternatively, the intermediate screen support frame component of the existing screening arrangement may be removed and the screen support frame component in which the base is a channel may then be secured to the support frame.

When the screen support frame component has a base which is a channel, a locating plate may be provided between the limbs of the channel for locating the screen support frame component on the support frame.

DESCRIPTION OF THE DRAWINGS

The invention is now described with reference to the accompanying drawings, in which:

Referring to FIGS. 1 to 3 of the drawings, reference numeral 10 indicates in general a screening arrangement which includes a plurality of screen support frame components 12 in accordance with the invention mounted on a channel-shaped screen support frame 14. The screen support frame 14 extends between side plates 16 and it supports transversely extending supports 18. The screen support frame components 12 are secured to channels 20 which in turn are secured to and are supported by the screen support frame channels 14. The screen support frame components 12 support modular screening panels 22 of which only one is shown in FIG. 1 and three in FIG. 2. The screening panels 22 are of a hard wearing synthetic plastics material such as polyurethane and are removably secured to the screen support frame components 12 in a manner which is discussed later with reference to FIG. 6.

Figure 5:
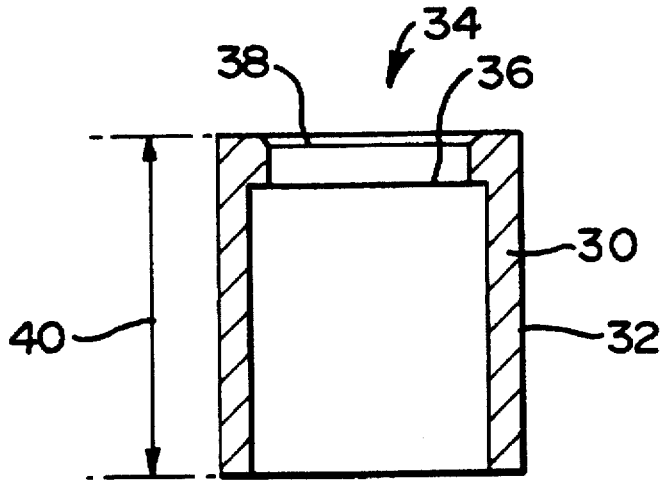
FIG. 5 shows a longitudinal sectional view of a spacer element included in the screen support frame component shown in FIGS. 1 to 4.

Each screen support frame component 12 includes a base 24 which is an elongate plate having a planar surface 26. A plurality of lugs 28 which are longitudinally spaced along the length of the base 24 are affixed to the base and project laterally on both sides of the base so that the planar surface 26 of the base 24 extends onto the laterally projecting lugs 28. A plurality of tubular spacer elements 30 are provided on the base 24 and on the lugs 28 to project upwardly from the planar surface 26. As shown in greater detail in FIG. 5, each tubular spacer element 30 has a tubular side wall 32 and one open axial end 34. It further has an annular shoulder 36 inwardly of the open end 34, and a sloping face 38 flaring outwardly towards the open end 34. The annular shoulder 36 constitutes a securing formation for securing the screening panels 22 in FIG. 6. Each spacer element 30 has a height 40.

The screening panel 22 has a screening surface 42 in which the screening apertures 44 are provided which extend through the panel to the underside 46 of the panel. As can be seen from FIG. 2, some of the screening apertures 44 along the marginal region of the panel are located over the base 24 of the screen support frame component 12.

Figure 3:
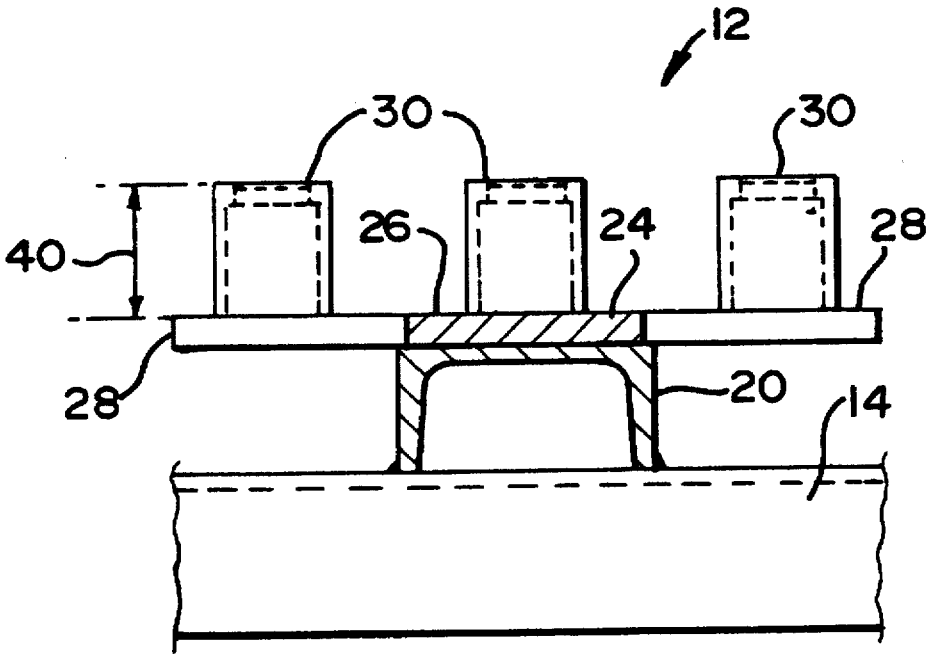
FIG. 3 shows on an enlarged scale a detail of the screen support frame component shown in FIG. 2.

Referring further to FIG. 3, the screen support frame component 12 is of a unitary construction in which the base 24, the lugs 28 and the spacer elements 30 are of steel, and all the components are secured together by welding. The base 24 is secured to the channel 20, which is also of steel, by means of bolts extending through bolt holes 48 extending through the base 24 and through the channel 20, or alternatively by means of welding.

Figure 1:
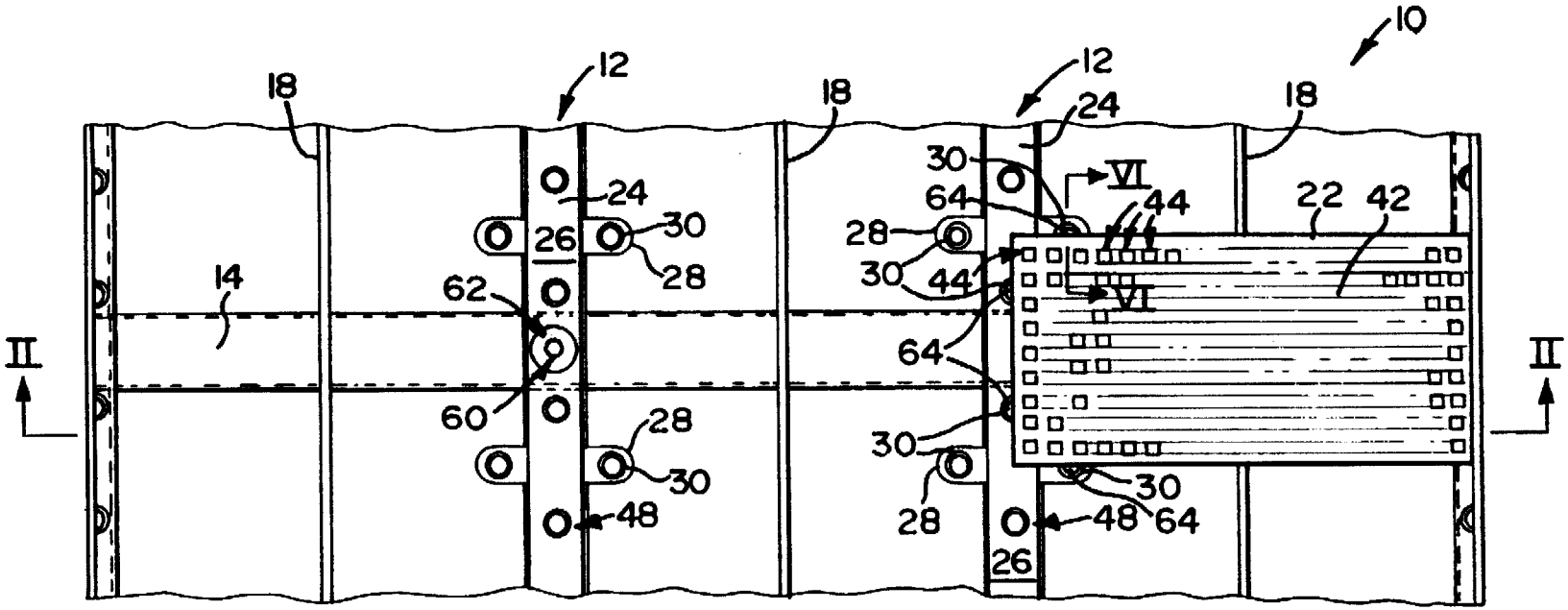
FIG. 1 shows a fragmentary plan view of a screen support frame component in accordance with the invention incorporated in a screening arrangement.
Figure 2:
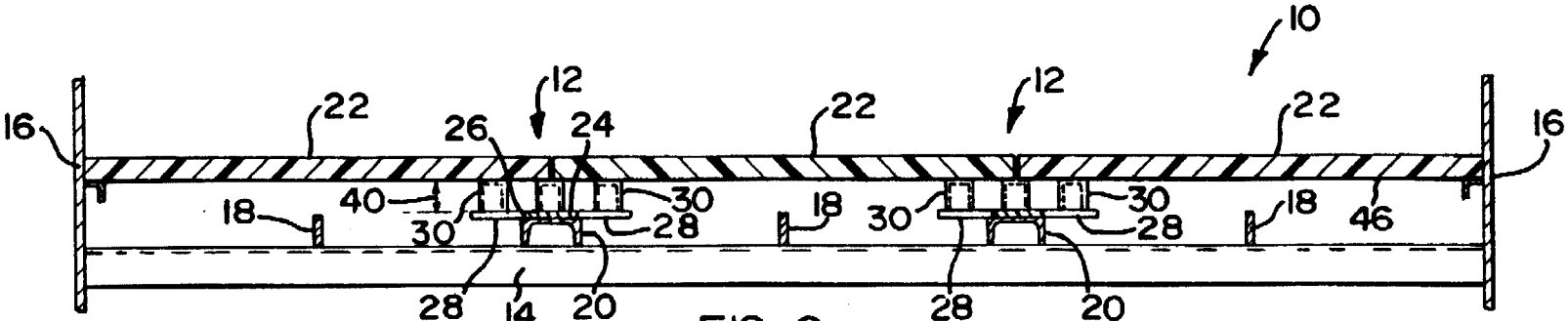
FIG. 2 shows a section on line II—II of the screen support frame component shown in FIG. 1.

Referring further to FIG. 2, it will be seen that when the screening panels 22 are secured to the screen support frame components 12 via the spacer elements 30, the undersides 46 of the screening panel 22 are spaced by the spacer elements 30 from the planar surface 26 of the bases 24 of the screen support frame components 12 by a distance 40 which is the height of each spacer element 30. This spacing 40 ensures that the screening apertures 44 of the screening panel 22 shown in FIG. 1 which are located above the base 24 and which, but for the spacing 40, would otherwise be blocked by the base 24, are exposed. Thereby material being screened on the screening panel 22 can fall through the screening apertures 44. Thus the effect of the spacing 40 is that the screening area of the screening surface 42 of the screening panel 22 is not impaired or reduced in any way even though some of the screening apertures 44 are located above the base 24 of the screen support frame component 12.

Figure 4:
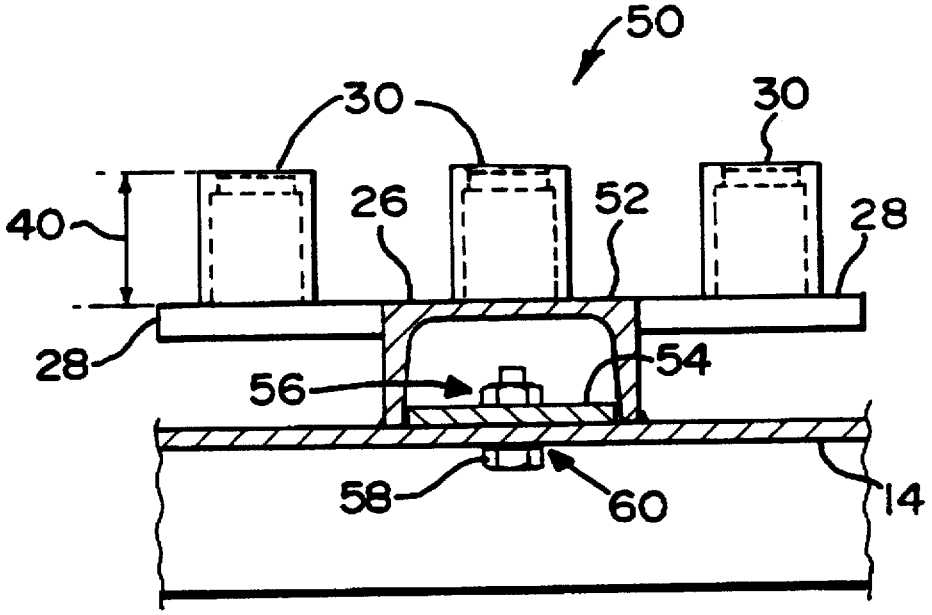
FIG. 4 shows a view similar to FIG. 3 of another embodiment of a screen support frame component in accordance with the invention.

Referring to FIG. 4, another embodiment 50 of a screen support frame component is shown. The screen support frame component 50 is identical to the screen support frame component 12 shown in FIGS. 1 to 3 except that it has a channel 52 instead of an elongate plate 24 to which the laterally extending lugs 28 are secured. The planar surface 26 and the spacer elements 30 are identical to those shown in the screen support frame component 12 in FIGS. 1 to 3. A flat steel plate 54 is welded between the limbs of the channel 52, and a bolt hole 56 is provided through this plate. A bolt 58 can be fitted through the bolt hole 56 and through corresponding bolt holes 60 through the support frame channel 14 to secure the screen support frame component 50 to the support frame channel 14. In order to provide access to secure the bolt 58, a hole 62 is provided through the support frame channel 14 as shown in FIG. 1.

Figure 6:
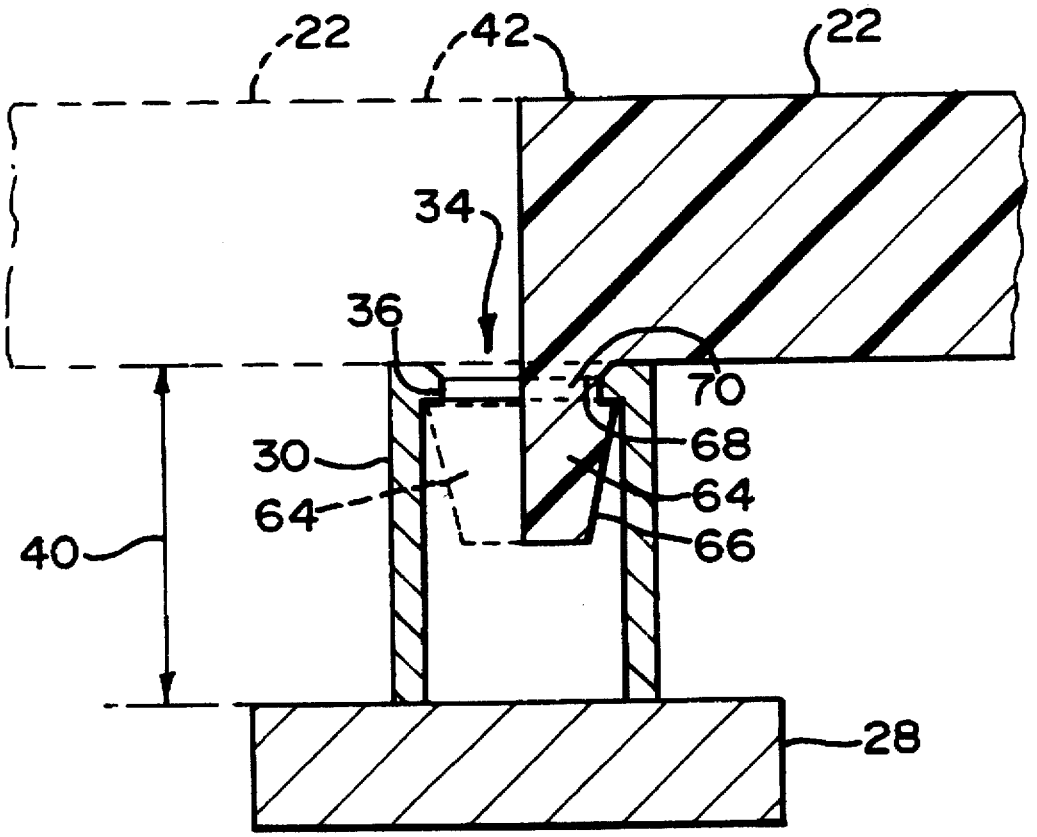
FIG. 6 shows on an enlarged scale a sectional view on line VI—VI of FIG. 1.

Referring to FIG. 6, the removable securing of the screening panel 22 to the tubular spacer element 30 is shown. The securing formation on the screening panel 22 is in the form of protrusions 64 which are spaced along the periphery of the panel. The spacing between the protrusions is complementary to the spacing between the spacer elements 30 as shown in FIG. 1. Each protrusion 64 has a sloping face 66 and a shoulder 68. It is attached to the panel by a stem 70. An adjacent screening panel is shown in dotted lines. The protrusions 64 on adjacent screening panels 22 are inserted in pairs through the open end 34 of the spacer element 30. The sloping faces 66 on the protrusions slide through the open end 34 until the shoulders 68 on the protrusions snap behind the annular shoulder 36 on the spacer element 30, and thereby the screening panels 22 are secured to the spacer element 30, and thus to the lug 28. The screening panels 22 and the protrusions 64 are of a resiliently deformable synthetic plastics material, for example polyurethane. By deforming the protrusions 64 the protrusions can be withdrawn from the spacer element 30, and thereby the screening panels 22 can be removed from the spacer element 30.

The method of converting a screening arrangement is now described with reference to FIGS. 1 and 2. In the screening arrangement to be converted, there are included the screen support frame 14, the support members 18 and the channels 20. Screens (not shown) such as wedge wire screens to be replaced, and which would be supported on the channels 20 and the support members 18, are removed. The screen support frame components 12 are then bolted onto the channels 20 by bolts fitted through the bolt holes 48, and the polyurethane screening panels 22 are fitted onto the spacer elements 30 of the screen support frame components 12 in the manner described with reference to FIG. 6. The undersides 46 of the screening panels 22 are thus spaced a distance 40 from the planar surfaces 26 of the bases 24. This ensures that screening apertures 44 in the screening panels 22 which are located above the bases 24 and which would otherwise have been blocked by the bases 24, are exposed and consequently the screening area of the screening surface 42 of each screening panel 22 is not reduced or impaired.

In an alternative method of conversion the screen support frame component 50 shown in FIG. 4 is employed. In this method the channels 20 shown in FIGS. 1 and 2 are removed after the wedge wire screens (not shown) have been removed. The screen support frame components 50 are then bolted onto the support frames 14 by means of the bolts 58 fitted through the bolt holes 56 and 60 by operating a fixing tool such as a wrench through the access holes 62 in the support frames 14.

It is an advantage of a screen support frame component in accordance with the invention that it permits screening panels to be fitted in a screen without any of the screening apertures being blocked by underlying screen frame supports, this being achieved by mounting the screening panels to be spaced from the surface of the underlying screen frame supports.

I claim:

1. A screen support frame component, said screen support frame component comprising a base having a planar surface, and a plurality of spacer elements on the base and projecting from the planar surface, each spacer element having a securing formation which is removably inter-engageable with a complementary securing formation on a screening panel, the spacing between the securing formations on the spacer elements being complementary to the spacing between complementary securing formations on a screening panel such that when a screening panel is secured to the screen support frame component by inter-engagement of the securing formations on the spacer elements with complementary securing formations on a screening panel, the underside of the screening panel is spaced from the planar surface of the base, in which the base is an elongate plate having a plurality of lugs spaced along the length of the base and projecting laterally on at least one side of the base and forming an extension of the planar surface of the base.

2. A screen support frame component as claimed in claim 1, in which each spacer element is of a tubular configuration having one open axial end and an annular ridge inwardly of the open end to form the securing formation on the spacer element, the spacer elements being provided on the lugs to project upwardly from the planar surface of the base.

3. A screen support frame component as claimed in claim 1, in which the base and the spacer elements are of steel and the spacer elements are secured to the base by means of welding.

4. A screen support frame component, said screen support component comprising a base having a planar surface, and a plurality of spacer elements on the base and projecting from the planar surface, each spacer element having a securing formation which is removeably inter-engageable with a complementary securing formation on a screening panel, the spacing between the securing formations on the spacer elements being complementary to the spacing between complementary securing formations on a screening panel such that when a screening panel is secured to the screen support frame component by inter-engagement of the securing formations on the spacer elements with complementary securing formations on a screening panel, the underside of the screening panel is spaced from the planar surface of the base, in which the base is a channel having a plurality of lugs spaced along the length of the base and projecting laterally on at least one side of the base and forming an extension of the planar surface of the base.

5. A screen support frame component as claimed in claim 4 in which each spacer element is of a tubular configuration having one open axial end and an annular ridge inwardly of the open end to form the securing formation on the spacer element, the spacer elements being provided on the lugs to project upwardly from the planar surface of the base.

6. A screen support frame component as claimed in claim 4 in which the base and the spacer elements are of steel and the spacer elements are secured to the base by means of welding.

7. A method of converting a screen support frame having a base provided with a planar surface, which includes the steps of providing a plurality of spacer elements on the support frame to project from the surface of the support frame, each spacer element having a securing formation which is removably inter-engageable with a complementary securing formation on a screening panel, and the spacing between the spacer elements being complementary to the spacing between complementary securing formations on a screening panel so that when a screening panel is secured to the support frame by inter-engagement of the securing formations on the screening panel with the securing formations on the spacer element, the underside of the screening panel is spaced from the surface of the support frame, providing a plurality of lugs along the length of the base to project laterally on at least one side of the base and to extend the planar surface of the base.

8. A method of converting a screen support frame component which includes the steps of providing a base having a planar surface and a plurality of spacer elements on the base and projecting from the planar surface, each spacer element having a securing formation which is removably inter-engageable with a complementary securing formation on a screening panel, the spacing between the securing formations on the spacer elements being complementary to the spacing between complementary securing formations on a screening panel such that when a screening panel is secured to the screen support frame component by inter-engagement of the securing formations on the spacer elements with complementary securing formation on a screening panel, the underside of the screening panel is spaced from the planar surface of the base, in which the base is a channel having a plurality of lugs spaced along the length of the base and projecting laterally on at least one side of the base and forming an extension of the planar surface of the base.

* * * * *